US006406610B1

(12) United States Patent
Lowe

(10) Patent No.: US 6,406,610 B1
(45) Date of Patent: Jun. 18, 2002

(54) ELECTRO-PLATING METHOD AND APPARATUS USING A CATHODE HAVING A PLURALITY OF CONTACTS

(75) Inventor: John Michael Lowe, Market Harborough (GB)

(73) Assignee: Technology Development Associate Operations Limited (GB)

( * ) Notice: Subject to any disclaimer, the term of this patent is extended or adjusted under 35 U.S.C. 154(b) by 0 days.

(21) Appl. No.: 09/526,647

(22) Filed: Mar. 15, 2000

(51) Int. Cl.[7] ..... C25D 5/00

(52) U.S. Cl. ..... 205/137; 205/137; 205/138; 204/206; 204/198; 204/288.3

(58) Field of Search ..... 205/137, 138; 204/224 R, 198, 202, 206, 279, 288, 288.2, 288.3, 212

(56) References Cited

U.S. PATENT DOCUMENTS 4,755,271 A * 7/1988 Hosten ..... 204/198
4,800,001 A * 1/1989 Ott et al. ..... 205/125
6,139,712 A * 10/2000 Patton et al. ..... 205/143
6,153,064 A * 11/2000 Condra et al. ..... 204/198

* cited by examiner

*Primary Examiner*—Donald R. Valentine
*Assistant Examiner*—Wesley A. Nicolas
(74) *Attorney, Agent, or Firm*—Jones, Walker, Waechter, Poitevent, Carrere & Denegre, L.L.P.

(57) ABSTRACT

Electro-plating apparatus 1 has an electro-plating bath 2 containing electrolyte 3, an anode configuration immersed in electrolyte 3 being a planar anode 4 and an arcuate solid anode 5. In use, a continuous web of flexible substrate 6 (onto both side of which material is to be deposited) is passed along a transport system 7 in a direction shown by arrow A. Transport system 7 comprises a set of rollers 8, 9 of which rollers 8 are generally cylindrical, driving rollers while rollers 9 are cathode connectors and have a number of circumferential projections 10 which ensure electrical contact with unconnected or discreet regions on substrate 6. Another electro-plating apparatus 20 has a cathode connector configuration 21 with four comb electrodes 22 each having a main portion 23 with a plurality of teeth 24 each of which has end 25 inclined in the direction of the movement fo the substrate.

40 Claims, 6 Drawing Sheets

ELECTRO-PLATING METHOD AND APPARATUS USING A CATHODE HAVING A PLURALITY OF CONTACTS

This application claims priority to Great Britain Patent Application No. 0005883.4, filed on Mar. 13, 2000.

The present invention related to electroplating apparatus and a method of electro-plating.

In a conventional electro-plating process, the object to be plated is immersed in a bath of electrolyte together with, but not touching, one or more pieces of the metal with which it is to be plated. Connections are made to a source of electrical current such that the item to be plated becomes the cathode and the pieces of metal become the anode. When an electric current is supplied, ions flow towards the cathode and are reduced thereon to give a coating of the metal from which the anodes are made.

In another electro-plating process, described in International Patent Application No. W99/52336, conductive tracks are provided on a printed circuit by use of a toll having an absorptive member carrying a plating solution.

According to the present invention, there is provided electro-plating apparatus comprising a cathode connector for contact with a substrate onto which material is to be deposited, wherein the cathode connector has means to contact a plurality of discrete regions extending across the width of the substrate and normal to the direction of movement of the substrate and not in the plane of the substrate.

According to the present invention, there is also provided electro-plating apparatus comprising an elongate connector cathode for movement relative to a substrate on which material is to be deposited, the cathode connector having a main body section lying along the longitudinal axis of the cathode connector and at least one projection which extends away from the main body section.

In this way, apparatus of the invention may ensure that electrical contact is maintained with portions of the substrate which would be otherwise electrically isolated from the main body of the substrate.

The present invention may include any one or more of the following preferred features:

- the cathode connector comprises a comb-shaped element having an elongate body and at least one tooth extending away from the main body section towards a locations for a substrate on which material is to be deposited, to contact in use a portion of the substrate.
- at least one tooth is flexibly biased towards a location for a substrate on which material is to be deposited.
- the tooth or teeth comprised an end portion inclined, relative to the reminder of the tooth, in a direction towards a location of the substrate to provide flexible bias towards a location for a substrate on which material is to be deposited.
- the cathode connector comprises a roller having at least one disk extending away from the roller towards a location for a substrate on which material is to be deposited, to contact in use a portion of the substrate.
- the cathode connector is formed of copper, or beryllium copper, or phosphor bronze, or stainless steel, or any other material with the required electrical and mechanical properties.
- means to pass a substrate, onto which material is to be deposited, over the cathode the length of which extends a substantial part of, or all, the width of the substrate.
- an electro-plating bath into which the substrate is immersed for deposition of material.

- the cathode connector is located adjacent to the path of a substrate to contact, in use, the substrate before entering the bath.
- the cathode connector is located adjacent to the path of a substrate to contact, in use, the substrate after leaving the bath.
- cleaning means to remove electrolyte from the substrate downstream of the cathode connector.
- cleaning means to remove electrolyte from the substrate upstream of the cathode connector.
- at least one nozzle means to direct cleansing fluid towards the substrate.
- electroplating means to effect dry plating of material onto a substrate.
- a tool having an absorptive member to carry plating solution.
- the electrode comprises a plurality of teeth or discs, one or more to contact electrically with a separate region which is isolated from other regions of the substrate on the substrate.
- the teeth or discs are adjustably spaced along the main portion.

The present invention provides an electroplating method to deposit a material onto a substrate, the method comprising applying a cathode connector to contact with a plurality of discrete regions extending across the width of the substrate and normal to the direction of the movement of the substrate and not in the plane of the substrate.

The present invention may also provide an electroplating method comprising moving an elongate cathode connector relative to a substrate on which material is to be deposited, the cathode connector having a main body section lying along the longitudinal axis of the cathode connector and at least one projection which extends away from the main body section.

The method may include any one or more the following preferred features:

- passing a substrate, onto which material is to be deposited, over the cathode connector the length of which extends a substantial or part of, or all, the width of the substrate.
- immersing the substrate, onto which material is to be deposited into an electroplating bath containing electrolyte.
- passing the substrate over the cathode connector located adjacent to the path of a substrate to contact the substrate before entering the bath.
- passing the substrate over the cathode connector located adjacent to the path of a substrate to contact with the substrate after leaving the bath.
- cleaning the substrate downstream of the cathode connector to remove electrolyte.
- cleaning the substrate upstream of the cathode connector to remove electrolyte.
- effecting dry plating of material onto a substrate.

Apparatus or methods of the present invention as described herein may provide the following advantages:

- effective electroplating of isolated regions (i.e. not connected with one another) of the substrate is ensured.
- effective electro-plating is achieved even for highly-flexible substrates.
- effective electro-plating is achieved even for substrates having very roughened surface.

The invention is applicable to electro-plating processes including, but not limited to, those as described hereinabove.

In order that the present: invention may more readily be understood, a description is now given, by way of example only, reference being made to the accompanying drawings, in which.

Figure 1:
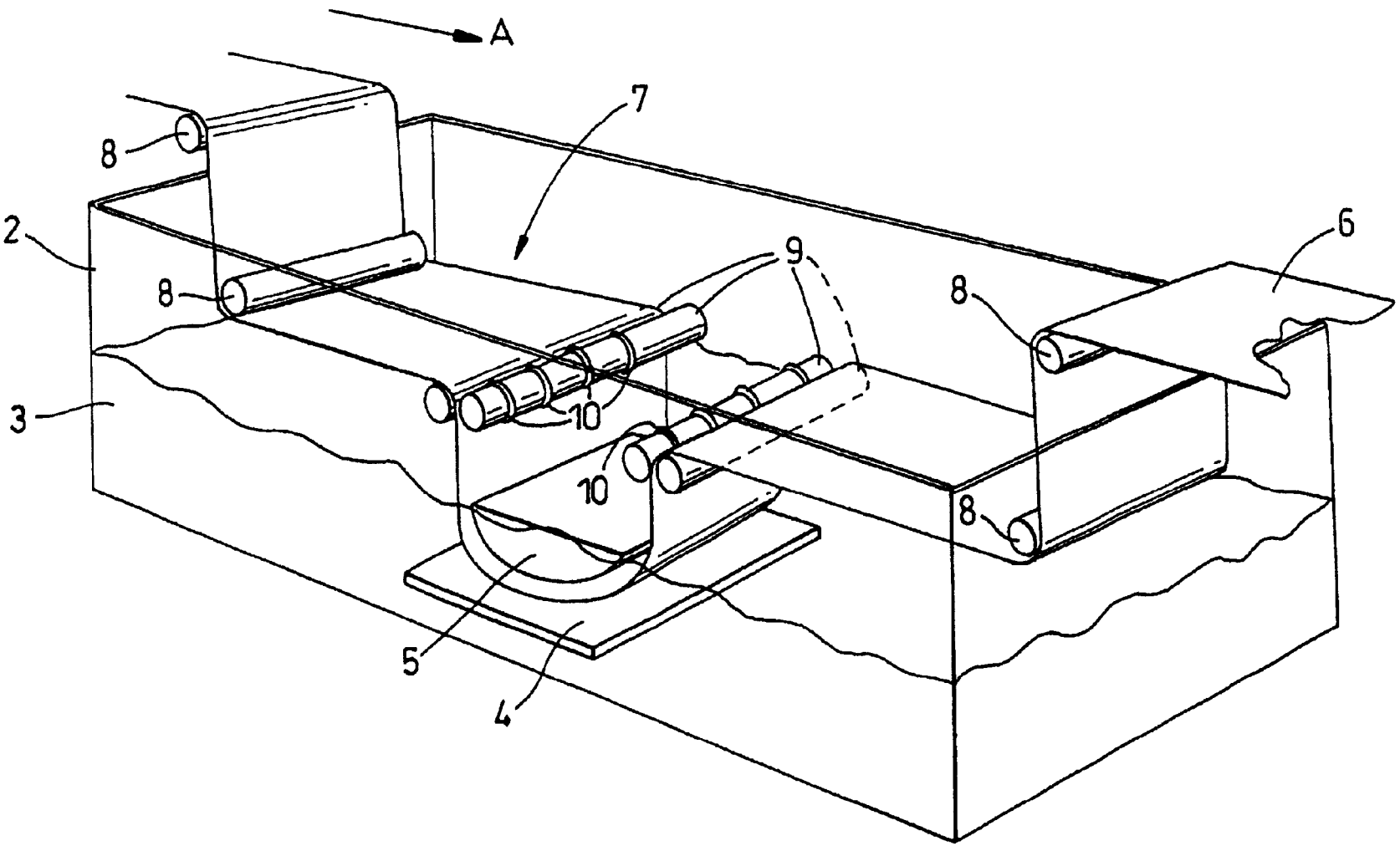
FIG. 1 is a block schematic drawing of electroplating apparatus embodying the present invention.

Electro-plating apparatus 1 as shown in FIG. 1 comprises an electro-plating bath 2 containing electrolyte 3, an anode configuration immersed in electrolyte 3 and comprising a planar anode 4 and an arcuate solid anode 5. In use, a continuous web of flexible substrate 6 (onto both sides of which material is to be deposited) is passed along a transport system 7 in a direction shown by arrow A. Transport system 7 comprises a set of rollers 8,9 of which rollers 8 are generally cylindrical, driving rollers while rollers 9 are cathode connector and have a number of circumferential projections 10 which ensure electrical contact (in spite of the transport speed, substrate flexibility or roughness of substrate 6) with unconnected or discrete regions on substrate 6.

Figure 2:
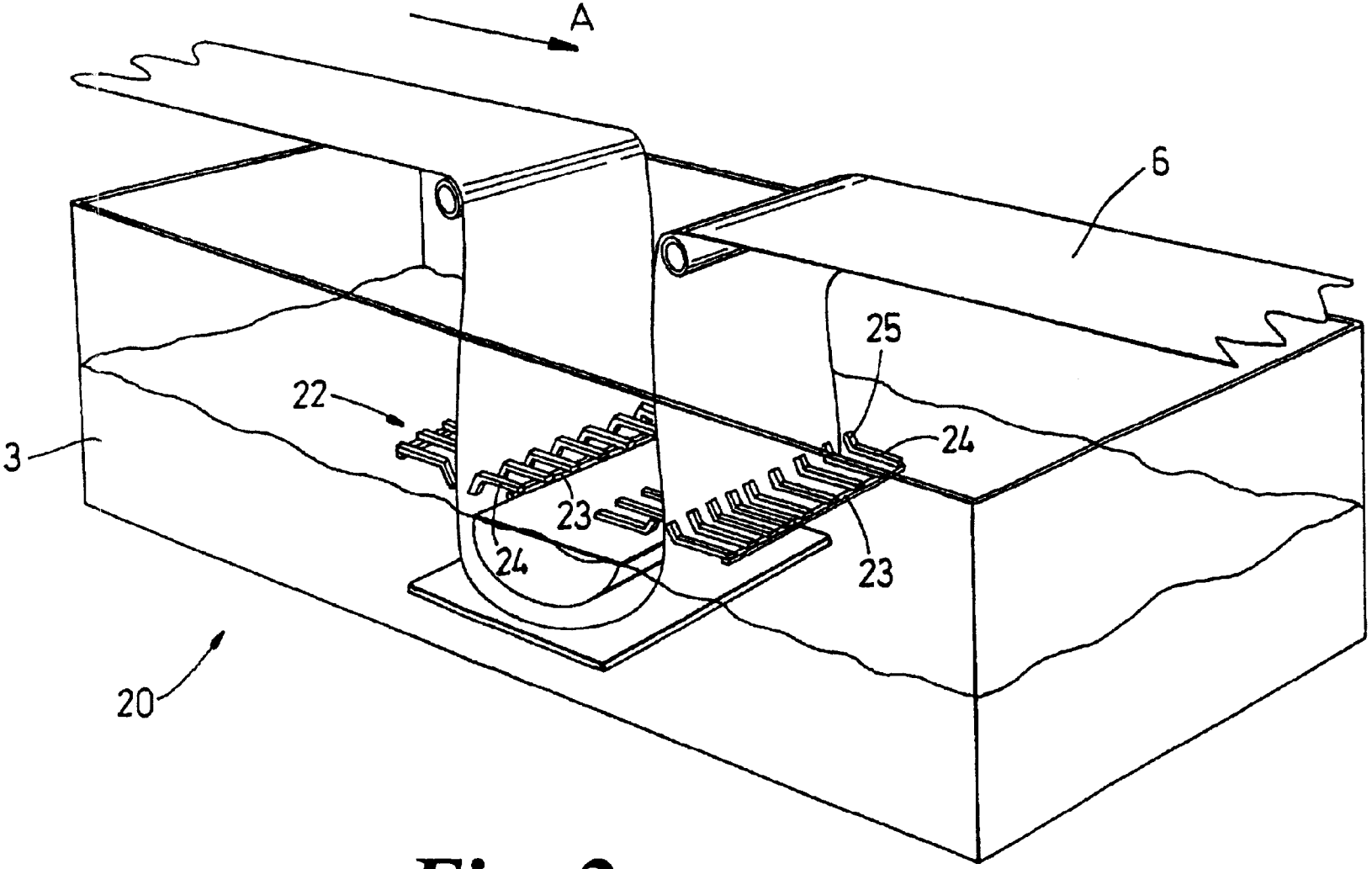
FIG. 2 is a schematic drawing of an alternative apparatus.

FIG. 2 shows another electroplating apparatus 20 having a cathode connector configuration 21 with four comb electrodes 22 each having a main portion 23 with a plurality of teeth 24 each of which has end 25 inclined in the direction of the movement of the substrate.

In each embodiment, the teeth 24 may be equi-spaced along the comb main portion 23 or they may be spaced to fit with the required region spacing of the substrate. The positioning of the teeth along the main portion 23 may be adjustable to accommodate either option.

Figure 3A:
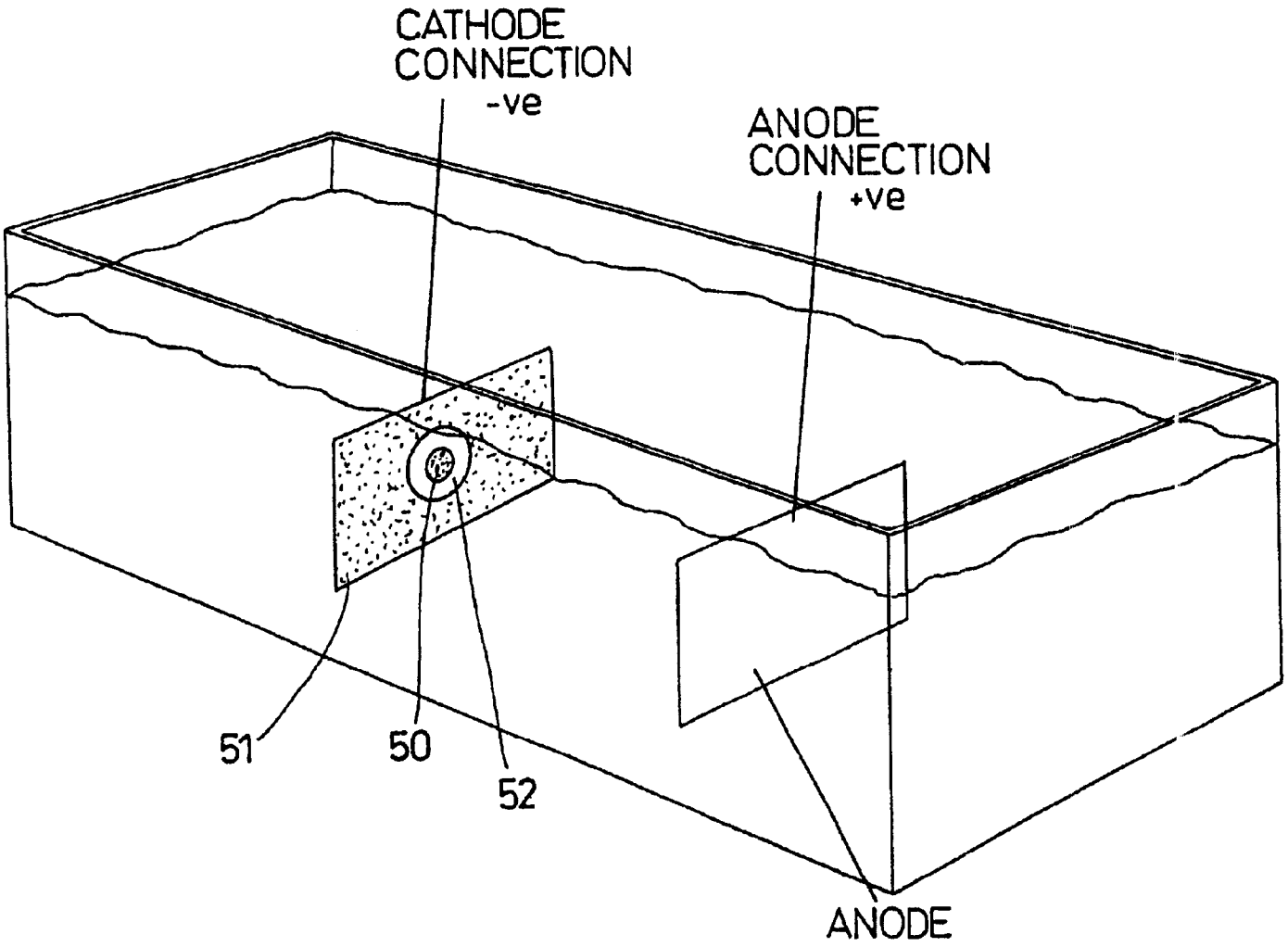
FIG. 3A is a detailed view of part of a conventional apparatus.

FIG. 3A show the problem associated with disconnected areas in a conventional plating bath. The inner conducting area 50 is electrically isolated from the outer conducting area 51 by the non-conducting area 52 and, therefore, the inner area 50 is not connected electrically to the negative terminal 53 of the current source.

Figure 3B:
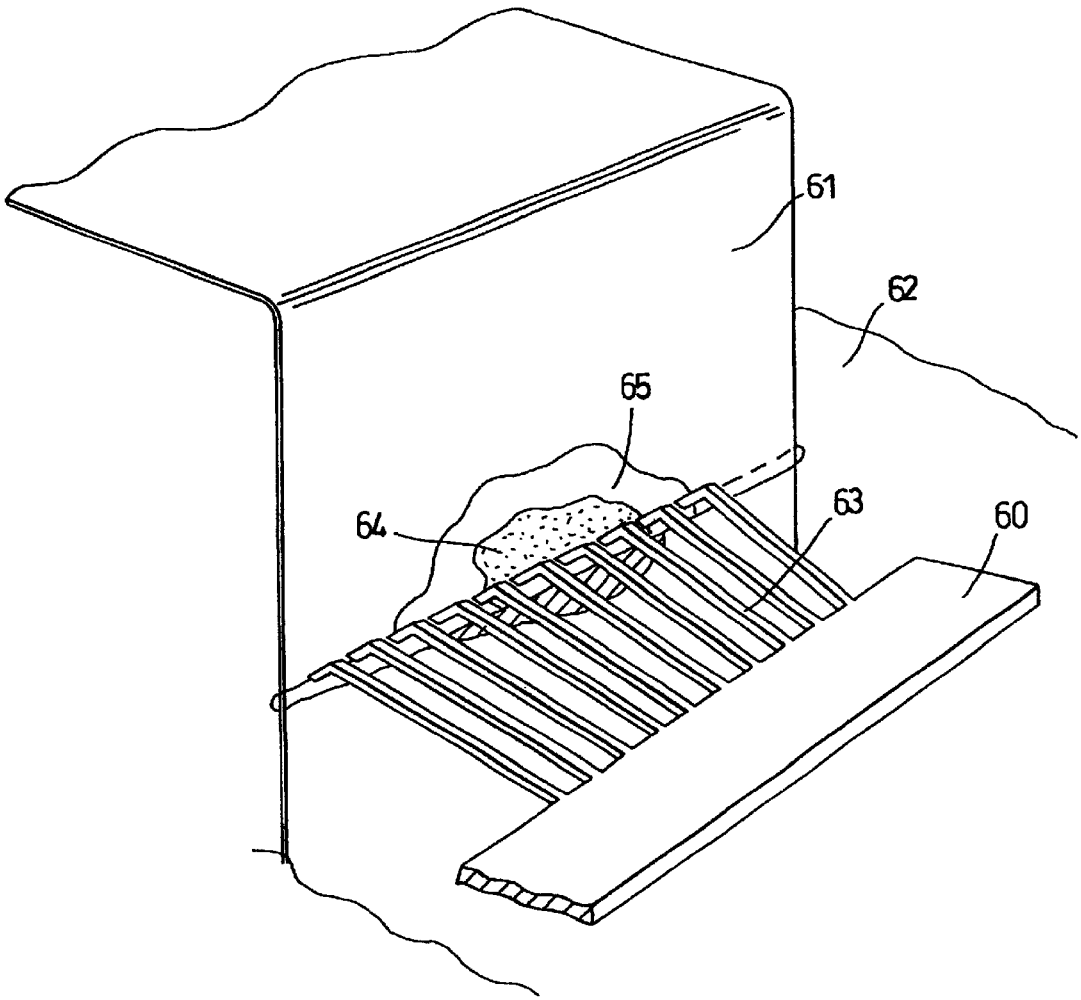
FIG. 3B is a detailed view of part of the apparatus of FIG. 2.

FIG. 3B shows how cathode connector 60 connects discrete areas to the negative potential and shows the use of a cathode connector 60 whereby the substrate 61 passes over the cathode connector 60 just prior to entering the electrolyte 62. All conducting areas on the substrate 61 are contacted by one or more fingers 63 of the cathode connector 60 such that contact is maintained until at least 50% the length, in the direction of substrate travel, has passed into the electrolyte 62. The gap between the cathode connector 60 and the electrolyte 62 causes a portion of the conducting parts of the substrate not to be plated because of the loss of contact. These portions are plated at the time of exit from the electrolyte 62 when the already plated area make contact with a further cathode connector situated just above the point at which the substrate exits the electrolyte 62. Conducting area 64 on substrate 61 is surrounded by nonconducting areas 65 but fingers 63 of cathode 60 still make contact to ensure electro-plating happens.

Figure 4:
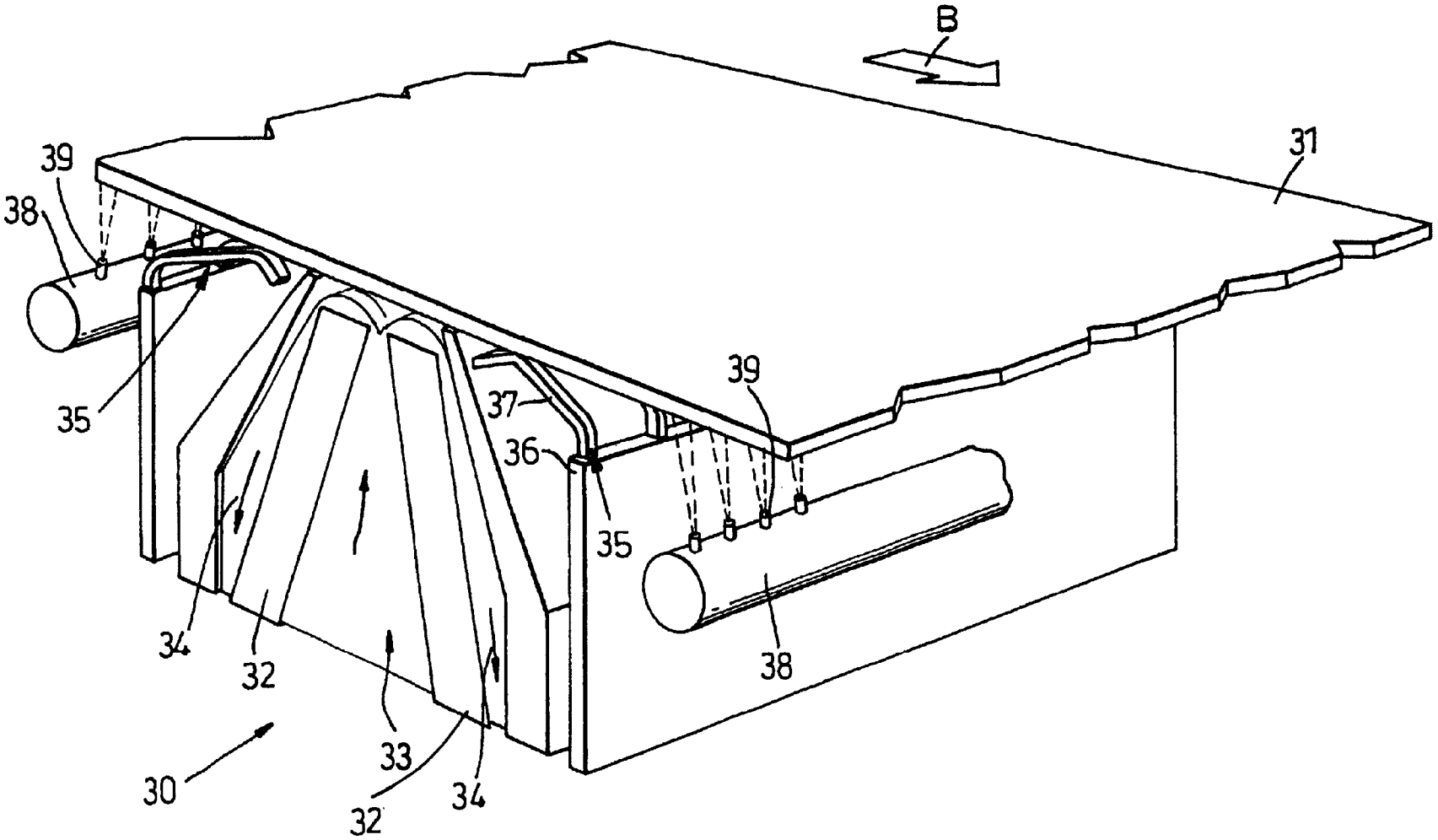
FIG. 4 is a schematic drawing of a further embodiment of apparatus.

FIG. 4 shows an electro-plating apparatus 30 for plating a rigid substrate 31 which hence cannot be immersed in an electrolyte bath in the manner of FIGS. 1 and 2. Apparatus 30 comprises a hollow anode 32 through the centre of which electrolyte 33 is directed onto a portion of substrate 31 moving in direction B and then removed along side channels 34. Cathode connectors 35 are in the form of comb main portions 36 with teeth 37 to ensure that unconnected regions of substrate 31 are electrically connected to cathode connectors 35 before and after impingement of electrolyte 33 to ensure that there is adequate deposition of material onto all required parts of substrate 31.

Two cleaners 38 with nozzles 39 are provided to direct de-ionised water onto the substrate 30 before and after contact with cathodes 35.

In a variant, roller 8 or main comb portion 23 may have a brush instead of projections 10, disc or teeth 24 to contact the discrete or unconnected regions on substrate 6.

Figure 5:
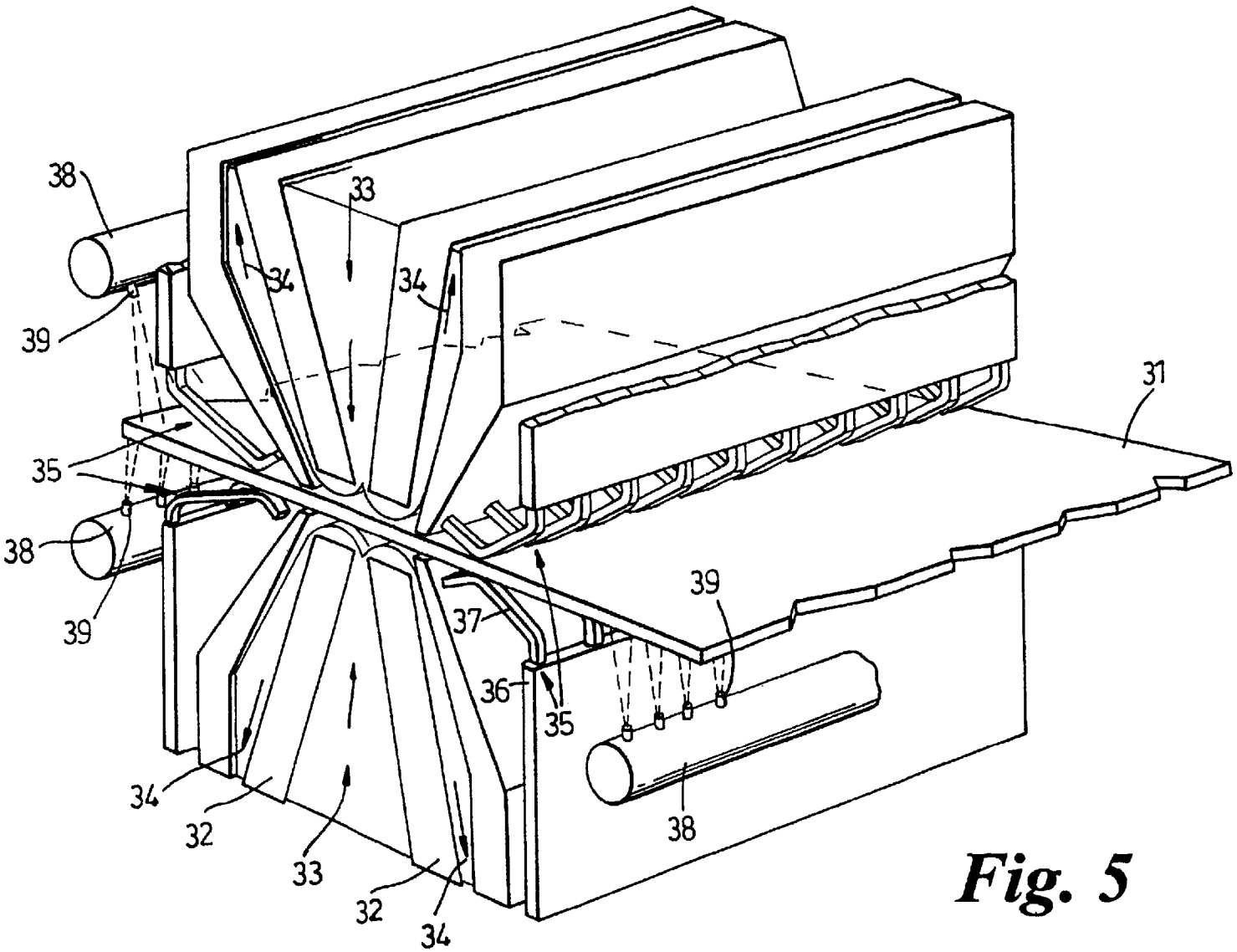
FIG. 5 is a schematic drawing of a further embodiment of apparatus.

FIG. 5 shows a variant of the apparatus of FIG. 4 but wherein both sides of substrate 31 are plated.

What is claimed is:

1. Electro-plating apparatus comprising a cathode connector for contact with a substrate onto which material is to be deposited, wherein the cathode connector has means to contact a plurality of discrete regions extending substantially across the width of the substrate and normal to the direction of movement of the substrate, when present, and not in the plane of the substrate.

2. Apparatus according to claim 1 comprising an elongate cathode connector for movement relative to a substrate on which material is to be deposited, the cathode connector having a main body section lying along the longitudinal axis of the cathode and at least one projection which extends away from the main body section.

3. Apparatus according to claim 1 wherein the cathode connector comprises a comb-shaped element having an elongate body and at least one tooth extending away from the main body section towards a location for a substrate on which material is to be deposited, to contact in use a portion of the substrate.

4. Apparatus according to claim 1 wherein said means to contact is at least one tooth is flexibly biased towards a location of a substrate on which material is to be deposited.

5. Apparatus according to claim 4 wherein said at least one tooth comprises an end portion inclined, relative to the remainder of the tooth, in a direction towards a location of the substrate to provide flexible bias towards a location of a substrate on which material is to be deposited.

6. Apparatus according to claim 1 wherein the cathode connector comprises a roller having at least one disk extending away from the roller towards a location for a substrate on which material is to be deposited, to contact in use a portion of the substrate.

7. Apparatus according to claim 1 wherein the cathode connector is formed of copper or beryllium copper, or phosphor bronze, or stainless steel.

8. Apparatus according to claim 1 comprising means to pass a substrate, onto which material is to be deposited, over the cathode connector the length of which extends a substantial part of, or all, the width of the substrate.

9. Apparatus according to claim 1 comprising an electroplating bath into which the substrate is immersed for deposition of material.

10. Apparatus according to claim 1 wherein the cathode connector is located adjacent to the path of a substrate to contact, in use, the substrate before entering the bath.

11. Apparatus according to claim 1 wherein the cathode connector is located adjacent to the path of a substrate to contact, in use, the substrate after leaving the bath.

12. Apparatus according to claim 1 comprising cleaning means to remove electrolyte from the substrate downstream of the cathode.

13. Apparatus according to claim 1 comprising cleaning means to remove electrolyte from the substrate upstream of the cathode connector.

14. Apparatus according to claim 1 comprising at least one nozzle to direct cleansing fluid towards the substrate.

15. Apparatus according to claim 1 comprising electroplating means to effect dry plating of material onto a substrate.

16. Apparatus according to claim 11 comprising a tool having a absorptive member to carry plating solution.

17. Apparatus according to claim 1 wherein the cathode connector comprises a plurality of teeth or discs, one or more to contact electrically with a separate region which is isolated from other regions of the substrate on the substrate.

18. Apparatus according to claim 1 wherein teeth or discs are adjustably spaced along the main portion of the cathode.

19. Electro-plating method to deposit a material onto a substrate, the method comprising applying a cathode connector to contact with a plurality of discrete regions extending substantially across the width of the substrate and normal to the direction of movement of the substrate and not in the plane of the substrate.

20. A method according to claim 19 comprising moving an elongate cathode connector relative to a substrate on which material is to be deposited, the cathode connector having a main body section lying along the longitudinal axis of the cathode connector and at least one projection which extends away from the main body section.

21. A method according to claim 19 wherein the cathode connector comprises a comb-shaped element having an elongate body and at least one finger extending away from the main body section towards a location for a substrate on which material is to be deposited, to contact in use a portion of the substrate.

22. The method according to claim 19 wherein said connector includes at least one tooth flexibly biased towards a location of a substrate on which material is to be deposited.

23. A method according to claim 22 wherein said at least one tooth comprises an end portion inclined, relative to the remainder of the tooth, in a direction towards a location of the substrate to provide flexible bias towards a location for a substrate on which material is to be deposited.

24. A method according to claim 19 wherein the cathode connector comprises a roller having at least one disk extending away from the roller towards a location for a substrate on which material is to be deposited, to contact in use a portion of the substrate.

25. A method according to claim 19 wherein the cathode is formed of copper or beryllium copper, or phosphor bronze, or stainless steel.

26. A method according claim 19 comprising passing a substrate, onto which material is to be deposited, over the cathode connector the length of which extends a substantial or part of, or all, the width of the substrate.

27. A method according to claim 19 comprising immersing the substrate, onto which material is to be deposited, into an electro-plating bath containing electrolyte.

28. A method according to claim 19 comprising passing the substrate over the cathode connector located adjacent to the path of a substrate to contact the substrate before entering the bath.

29. A method according to claim 19 comprising passing the substrate over the cathode connector located adjacent to the path of a substrate to contact with the substrate after leaving the bath.

30. A method according to claims 19 comprising cleaning the substrate downstream of the cathode connector to remove electrolyte.

31. A method according to claim 19 comprising cleaning the substrate upstream of the cathode to remove electrolyte.

32. A method according to claim 19 comprising directing a cleansing fluid against the substrate.

33. A method according to claim 19 comprising effecting dry plating of material onto a substrate.

34. A method according,to claim 19 comprising a tool having a absorptive member to carry plating solution.

35. A method according to claim 19 wherein the cathode connector comprises a plurality of teeth or discs, one or more to contact electrically with a separate region which is isolated from other regions of the substrate on the substrate.

36. A method according to claim 19 comprising adjusting the spacing of the teeth or discs along the main portion of the cathode.

37. An electroplating apparatus comprising:

a. an electroplating bath;

a. transport system for moving a substrate, when present, along a path in contact with said bath;

c. an electrode of a first polarity positioned in said bath along said substrate path; and d. an electrode of a second polarity, said electrode extending substantially across a width of said substrate path, said electrode having a plurality of discrete contact surfaces positioned to engage a substrate on said path.

38. An electroplating apparatus according to claim 37, wherein said discrete contact surfaces are disk sections formed on a roller.

39. An electroplating apparatus according to claim 37, wherein said discrete contact surfaces are tooth elements extending from a main electrode body.

40. An electroplating apparatus according to claim 37, wherein said electrode of a first polarity is an anode and said electrode of a second polarity is a cathode.

* * * * *